United States Patent [19]

Fransen

[11] 4,407,657

[45] Oct. 4, 1983

[54] GETTERING DEVICE AND METHOD

[75] Inventor: Jan J. B. Fransen, Eindhoven, Netherlands

[73] Assignee: U.S. Philips Corporation, New York, N.Y.

[21] Appl. No.: 262,003

[22] Filed: May 8, 1981

[30] Foreign Application Priority Data

May 16, 1980 [NL] Netherlands ..... 8002837

[51] Int. Cl.[3] ..... H01J 9/20

[52] U.S. Cl. ..... 445/17; 445/31; 445/55; 313/481; 313/551; 417/48

[58] Field of Search ..... 417/48; 316/3, 25; 252/181.2, 181.4, 181.6; 313/481, 551; 445/17, 31, 55

[56] References Cited

U.S. PATENT DOCUMENTS

| | | | |
|---|---|---|---|
| 3,195,716 | 7/1965 | Porta | 417/48 |
| 3,669,567 | 6/1972 | Porta | 417/48 |
| 3,927,953 | 12/1975 | Zucchinelli | 417/48 |
| 3,979,166 | 9/1976 | Zucchinelli | 417/48 |

FOREIGN PATENT DOCUMENTS

| | | | |
|---|---|---|---|
| 1405045 | 9/1975 | United Kingdom | 316/25 |

*Primary Examiner*—Kenneth J. Ramsey
*Attorney, Agent, or Firm*—Robert J. Kraus

[57] ABSTRACT

In a method of manufacturing a picture display tube a gettering device is used which includes a first metal holder (1, 20) and a second metal holder (3, 28). A source (2, 21) of evaporable gettering metal is accommodated in the first metal holder (1, 20) from which the gettering metal can be released by inductive heating. A gas source (6) including a material having a comparatively high decomposition temperature, which releases gas upon heating, is accommodated in the second metal holder. The second metal holder is connected to an outer surface (7, 30) of the first metal holder in such manner that the second metal holder forms an electric shunt for part of the induction current generated in the first metal holder by the inductive heating. During the inductive heating the temperature of the second metal holder and its contents lead increases faster than that of the contents of the first metal holder and the gas-releasing material (6) begins releasing its gas before the gettering metal begins to evaporate from the source (2, 21) of gettering metal.

12 Claims, 3 Drawing Figures

GETTERING DEVICE AND METHOD

BACKGROUND OF THE INVENTION

The invention relates to a method of manufacturing a picture display tube, in which method a gettering device is provided in the tube. The gettering device comprises a first metal holder containing a source of evaporable gettering metal, a second metal holder connected to an outer surface of the first metal holder and containing a gas source consisting of a material which releases gas upon heating. The tube is evacuated and then the gettering device is heated inductively to release the gas from the gas source and to evaporate the gettering metal from the source of gettering metal.

The invention furthermore relates to a picture display tube thus manufactured as well as to a gettering device suitable for use in the above-mentioned method.

Such a method is disclosed in U.S. Pat. No. 3,768,884. In the known method the first metal holder comprises a ring of an inductively heatable material, in which ring the gettering metal to be evaporated and a first gas source of gas-releasing material are incorporated. The second metal holder comprises a second gas source of gas-releasing material. These first and second metal holders are separated from each other so that during the inductive heating the temperature of the second holder lags behind with respect to that of the first holder. In this manner first the gas from the first gas source is released, then the gettering metal is evaporated and during this evaporation the gas from the second gas source is released. The object of this known method is to cause the scattering effect which the released gas exerts on the evaporating gettering metal, to take place over a longer period of time than would be the case when only one single gas source is used.

The known gettering device is suitable when using gas sources which give off their gas at comparatively low temperatures. A frequently used gas source belonging to this category is iron nitride ($Fe_4N$) which begins to decompose at approximately 500° C. However, a number of restrictions are associated with the use of iron nitride, both with respect to the manufacture of the gettering device itself and with respect to the manufacture of the display tube in which said gettering device is to be used. For example, the low decomposition temperature of iron nitride restricts the maximum permissible temperature during degassing of the gettering device. Furthermore, iron nitride cannot withstand the action of moist air at approximately 450° C. which conditions occur during the manufacture of a colour television display tube when the display window and the cone of the display tube are sealed together by means of a sealing glass. The use of iron nitride then does not permit the gettering device to be provided in the tube before the display window and the cone have been sealed together. This is a serious restriction, especially in the manufacture of colour display tubes having a resistive layer provided internally on a part of the tube wall, as described in British Patent Specification No. 1,226,728. This resistive layer is located near the neck-cone transition of the tube and this makes it necessary for the gettering device to be mounted in the tube in a place remote from the neck-cone transition to prevent the resistive layer from becoming electrically short-circuited by gettering metal evapour-deposited from the gettering device. Because of the inaccessibility of such a place, it is preferable to install the gettering device before the cone is sealed to the window of the tube. Such installation also eliminates the conventional practice of attaching the gettering device to the gun system assembled in the neck of the tube by means of a resilient metal strip, to avoid the forces exerted on the gun system by the metal strip.

A gas source which does not exhibit the above-mentioned restrictions with respect to iron nitride is disclosed in British Patent Specification No. 1,405,045. In this Specification the gas source comprises germanium nitride, $Ge_3N_4$, as a gas-releasing material. Germanium nitride is a stable compound which can be exposed, without deterioration to moist air at a temperature of at least 450° C. However, as compared with iron nitride, germanium nitride has a comparatively high decomposition temperature and gives off its nitrogen only during the evaporation of the gettering metal. In order to obtain a layer of gettering material on an inner surface of the tube, which is porous through-out its thickness and hence is readily absorbent, it is necessary that during the heating of the gettering device and before the gettering metal begins to evaporate, the gas released from the gas source has built up a sufficient gas pressure of approximately $133\times10^{-3}$ to $666\times10^{-2}$ Pa in the tube.

SUMMARY OF THE INVENTION

It is an object of the invention to provide a method of manufacturing a picture display tube in which a gettering device is used which has a gas source which releases in its gas at a comparatively high temperature, but in which nevertheless begins releasing of gas before the gettering metal begins to evaporate.

According to the invention, a gettering device is provided which comprises a first metal holder containing a source of evaporable gettering metal and a second metal holder containing a gas source consisting of a material for releasing gas upon heating. The second holder is attached to an outer surface of the first metal holder. The tube is evacuated and the gettering device is then heated inductively to release the gas from the gas source and to evaporate the gettering metal from the source of gettering metal. The second metal holder forms an electric shunt for part of the induction current generated in the first metal holder during the inductive heating of the gettering device.

During the inductive heating, the gettering device will become warm first at the area where the induction current generated by the induction field in the gettering device are greatest. With a high-frequency induction field, the gettering device will first become warm on the outside, and the temperature of the metal holder of the gettering device increases faster than the filling of the holder. The invention uses this fact by connecting the second metal holder to an outer surface of the first metal holder in such a manner that part of the induction current generated in the first metal holder flows through the second metal holder. The temperature of the second metal holder increases faster than the contents of the first metal holder. As a result of the smaller heat capacity of the contents of the second metal holder with respect to the heat capacity of the contents of the first metal holder, the contents of the second metal holder also become warm sooner than those of the first metal holder. Consequently in spite of its comparatively high decomposition temperature, the gas-releasing material begins releasing its gas before the gettering metal begins to evaporate from the first metal holder.

According to an embodiment of the invention, the second metal holder includes a metal strip and a cavity containing the gas source. The metal strip is attached to an outer surface of the first metal holder in places situated on both sides of the cavity. The metal strip forms an electric shunt for part of the induction current generated in the first holder.

According to another embodiment of the invention, the gas source comprises a gas-releasing material which releases its gas only at temperatures higher than approximately 700° C. The advantage of such a gas source is that the gettering device can be pre-degassed to approximately 650° C. as a result of which gases, for example, argon, which are not absorbed as such by the layer of gettering metal provided in the tube are effectively removed from the tube. This is important because such gases can reduce the life of the tube in which the gettering device is used.

A very suitable gas-releasing material consists of a germanium nitride, in particular $Ge_3N_4$. Germanium nitride is a chemically resistant compound which begins to decompose in a vacuum at approximately 825° C. and decomposes very rapidly at approximately 900° C. When such a gas source is used in combination with a chemically resistant source of gettering metal, a gettering device is obtained which, compared with the known gettering devices, has the advantage that in the manufacture of a display tube it can be provided inside the tube envelope before the window and the cone of the display tube are sealed together. As already stated, this is important particularly in the manufacture of display tubes having a resistive layer provided internally on a part of the wall of the tube.

The gettering device may also be used in the manufacture of black-and-white display tubes. The resistance of the gettering device to the action of the ambient atmosphere is a great advantage since this enables storage of the gettering device for a long period of time without reducing the usefulnes of the gettering device.

BRIEF DESCRIPTION OF THE DRAWING

Some embodiments of the invention will now be described with reference to the drawing, in which.

DESCRIPTION OF THE PREFERRED EMBODIMENTS

Figure 1:
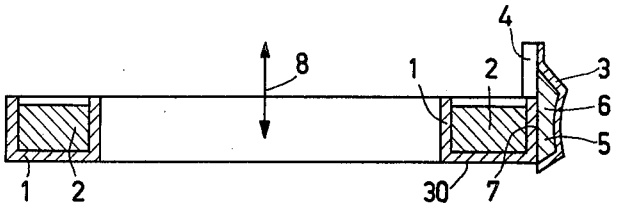
FIG. 1 is a sectional view of a gettering device suitable for use in a method according to the invention.
Figure 2:
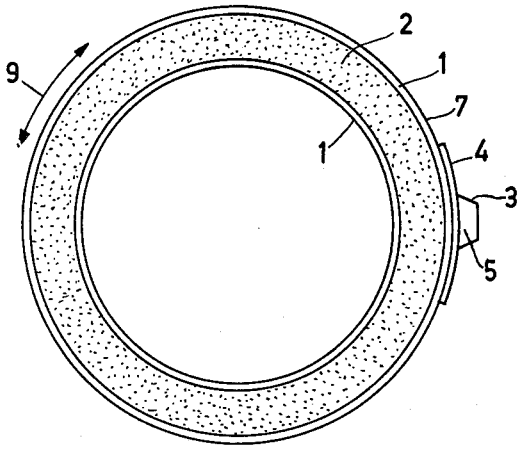
FIG. 2 is a plan view of the gettering device shown in FIG. 1.

The gettering device shown in FIGS. 1 and 2 comprises a first metal holder which consists of a chromium-nickel steel channel 1 in which a filling material 2 in powder form has been compressed. The filling material 2 comprises a source of gettering metal, which source consists of a mixture of barium aluminium powder ($BaAl_4$) and nickel powder, in which the content of nickel powder is approximately 40–60% by weight. By a suitable choice of the grain sizes of the barium aluminium powder and the nickel powder, the source of gettering material can withstand moist air at approximately 450° C. for at least one hour. As described in U.S. Pat. No. 4,077,899 the contents of which are to be considered as incorporated herein by reference, the nickel powder in such a source of gettering metal has an average grain size smaller than 80 microns and a specific area smaller than 0.15 $m^2$ per gram, while the average grain size of the barium aluminium powder is smaller than 125 microns. The gettering device further comprises a second metal holder 3 consisting of a chromium-nickel steel strip 4 having a cavity 5. The strip 4 is welded on both sides of the cavity 5 to the outer surface 7 of the channel 1. A gas source of germanium nitride 6 in powder form has been compressed in the cavity 5. The cavity 5 may be covered, if desired, with a metal band (not shown) which on the one hand does not prevent the escape of gas from the cavity 5, but on the other hand prevents particles of solid which have become detached from the compressed germanium nitride pill 6 from landing in the display tube. For the inductive heating the gettering device is subjected to a high-frequency induction field, in which the field lines have the direction indicated in FIG. 1 by the double arrow 8. As a result of this induction field, an induction current having the alternating directions denoted in FIG. 2 by the double arrow 9 is established in the metal holder 1. At the area where the second holder 3 is connected to the first holder 1, at least a part of the induction current also flows through said second holder. Since the filling material (germanium nitride) of the second holder 3 is only approximately 2 to 4% by weight of the filling material of the first holder, the temperature of the germanium nitride in the holder 3 rises much more rapidly than that of the mixture of barium aluminium powder and nickel powder in the holder 1. The germanium nitride thus decomposes before the barium begins to evaporate from the source of gettering material 2.

Although the second holder 3 in FIG. 1 is connected to an outer surface, which forms the outer circumference of the holder 1, this is not strictly necessary. In a manner analogous to that described above, the second holder 3 may be connected to an outer surface which forms the bottom 30 of the holder 1. The location depends on the place in the holder 1 where the largest induction currents are generated. At higher frequencies of the induction field (on the order of 375 kHz) the largest induction currents will be generated at the outer circumference of the holder 1. At lower frequencies of the order of 125 kHz, the largest induction currents will be generated at the bottom 30 of the holder 1.

Figure 3:
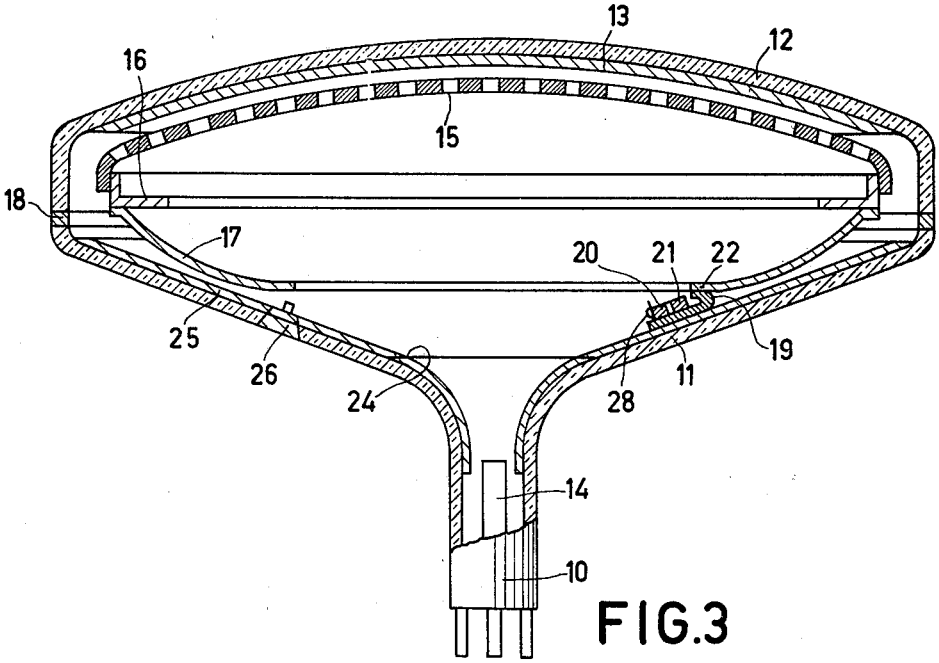
FIG. 3 is an axial sectional view of a colour television display tube manufactured using the gettering device shown in FIG. 1.

Since a gettering device according to the invention allow freedom of choice regarding the stage of manufacture of a display tube at which the gettering device is provided within the envelope of the display tube, the invention is very suitable for use in the manufacture of display tubes in which the gettering device is provided within the display tube envelope at an early stage of the manufacturing process. This aspect of the invention will be explained with reference to FIG. 3. The colour television display tube shown diagrammatically in FIG. 3 has a neck 10, a cone 11 and a window 12 which are each made of glass. On the inside of the window 12 a layer 13 of phosphor regions for fluorescing in red, green and blue is provided which in known manner constitutes a pattern of lines or a pattern of dots. The tube further comprises a metal shadow mask 15 and a metal magnetic screening cap 17 which are both secured to a metal supporting frame 16. A source 21 of gettering metal in the form of a mixture of barium aluminium powder and nickel powder is present in an annular metal holder 20 of a gettering device characterized according to the invention. A source of nitrogen in the form of germanium nitride powder is present in a holder 28 welded to the holder 20. A metal strip 19 is welded to the holder 20 and is connected to the screening cap 17 at 22. It is alternatively possible to connect the strip 19 to a voltage contact 26 sealed into the tube wall. After the gettering device has been installed, the window 12 is sealed to the cone 11 in a vacuum-tight manner by means of a sealing glass 18. During this process, which lasts approximately one hour and which takes place in a furnace at approximately 450° C., water vapour is released from the sealing material 18. The gettering device characterized according to the invention can be exposed to this environment without deterioration. After the sealing process has been completed, a system of guns 14 (shown diagrammatically) for producing three electron beams is placed in the neck of the tube and the tube is evacuated.

The gettering device (20, 28) is finally heated to a temperature, by inductive heating, in which first nitrogen is introduced into the tube by thermal decomposition by the germanium nitride, and then an exothermic reaction is started between the barium aluminium and the nickel. The barium evaporates, is scattered by the nitrogen, and is deposited as a thin layer of gettering metal on surfaces situated inside the volume bounded by the mask 15 and the screening cap 17. The location and spatial orientation of the gettering device are such that of a resistive layer 25 provided on the inner surface of the tube which is situated between the line denoted by 24 and the gun system 14 is not covered by barium. The object of the resistive layer 25 is to minimize the detrimental effect of a possible high voltage breakdown in the tube on certain components in the control circuit connected thereto. In conventional connection of the gettering device to the gun system or to an element connected to said gun system, said resistive layer is short-circuited by the deposited barium. This is prevented by the above-described positioning of the gettering device.

Although the invention has been described with reference to a gettering device comprising a mixture of barium aluminium powder and nickel powder as a source of gettering metal and comprising germanium nitride as a source of gas, it is not restricted thereto. The invention may also be used with other gettering metals, for example, strontium, calcium or magnesium. In order to obtain a chemically resistant source of gettering metal, measures other than those described above may be taken. For example, the nickel powder in the source may be replaced by a more chemically resistant nickel-titanium compound or iron titanium compound. It is also possible to cover the surface of the source of gettering metal exposed to the atmosphere by a protective layer of, for example, aluminium or an organo-silicon compound. This latter measure may also be taken with regard to the gas source, but in general this will not be necessary since gas-releasing materials having a comparatively high decomposition temperature are generally more chemically resistant than those having a low decomposition temperature.

What is claimed is:

1. A method of manufacturing a picture display tube comprising installing in the tube a gettering device holding a gas releasing material and an evaporable gettering metal, sealing and evacuating the tube, and applying an electromagnetic field to the device to induce therein an electrical heating current to effect release of the gas and evaporation of the gettering metal, characterized in that said gettering device includes a first metallic holder containing the evaporable gettering metal and a second metallic holder containing the gas-releasing material, said second holder being attached to a predetermined position on the first holder's outer surface where the electrical current of greatest magnitude is induced, for shunting sufficient electrical current from the first holder to effect heating of the material held in the second holder to its gas-releasing temperature before the gettering metal held in the first holder is heated to its evaporation temperature.

2. A method as in claim 1 characterized in that the second metallic holder comprises a metal strip forming a cavity for holding the gas-releasing material and having portions disposed on opposite sides of the cavity attached to the first metallic holder's outer surface.

3. A method as in claim 1 or 2 characterized in that the gas-releasing material begins releasing its gas at a temperature higher than approximately 700° C.

4. A method as in claim 3 characterized in that the gas-releasing material comprises a germanium nitride.

5. A method as in claim 4 characterized in that the gas-releasing material comprises $Ge_3N_4$.

6. A method as in claim 1 or 2 characterized in that the picture display tube is a color television display tube having a window portion sealed to a conical portion, said gettering device being installed in the tube before the window portion is sealed to the conical portion.

7. A picture display tube including a layer of gettering metal deposited on its inner surface by installing in the tube a gettering device holding a gas releasing material and an evaporable gettering metal, sealing and evacuating the tube, and applying an electromagnetic field to the device to induce therein an electrical heating current to effect release of the gas and evaporation of the gettering metal, characterized in that said gettering device includes a first metallic holder containing the evaporable gettering metal and a second metallic holder containing the gas-releasing material, said second holder being attached to a predetermined position on the first holder's outer surface where the electrical current of greatest magnitude is induced, for shunting sufficient electrical current from the first holder to effect heating of the material held in the second holder to its gas-releasing temperature before the gettering metal held in the first holder is heated to its evaporation temperature.

8. A gettering device for inductively heating and dispersing a gas and a gettering metal in an evacuated envelope, when an electrical heating current is induced in the device by means of an applied electromagnetic field, said device comprising a first metallic holder for an evaporable gettering metal and a second metallic holder for a gas-releasing material, characterized in that said second holder is attached to a predetermined position on the first holder's outer surface where the electrical current of greatest magnitude is induced, for shunting sufficient electrical current from the first holder to effect heating of the material held in the second holder to its gas-releasing temperature before the gettering metal held in the first holder is heated to its evaporation temperature.

9. A gettering device as in claim 8 characterized in that the second metallic holder comprises a metal strip forming a cavity for holding the gas-releasing material and having portions disposed on opposite sides of the cavity for attachment to the first metallic holder's outer surface.

10. A gettering device as in claim 8 or 9 characterized in that the gas-releasing material is a material which begins releasing its gas at a temperature higher than about 700° C.

11. A gettering device as in claim 10 characterized in that the gas-releasing material comprises a germanium nitride.

12. A gettering device as in claim 11 characterized in that the gas-releasing material comprises $Ge_3N_4$.

* * * * *